US010066861B2

(12) United States Patent
Gooden et al.

(10) Patent No.: US 10,066,861 B2
(45) **Date of Patent: *Sep. 4, 2018**

(54) ICE CUBE RELEASE AND RAPID FREEZE USING FLUID EXCHANGE APPARATUS

(71) Applicant: WHIRLPOOL CORPORATION, Benton Harbor, MI (US)

(72) Inventors: Corey M. Gooden, Saint Joseph, MI (US); Steven John Kuehl, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/360,526

(22) Filed: Nov. 23, 2016

(65) Prior Publication Data

US 2017/0074573 A1 Mar. 16, 2017

Related U.S. Application Data

(63) Continuation of application No. 14/551,157, filed on Nov. 24, 2014, now Pat. No. 9,534,824, which is a (Continued)

(51) Int. Cl.
*F25C 5/08* (2006.01)
*F25C 5/06* (2006.01)

(Continued)

(52) U.S. Cl.
CPC ..... *F25C 5/08* (2013.01); *F25C 1/24* (2013.01); *F25C 5/06* (2013.01); *F25C 5/10* (2013.01);

(Continued)

(58) Field of Classification Search
CPC .... F25C 1/24; F25C 5/005; F25C 5/10; F25C 5/08; F25C 5/06; F25C 2400/10;

(Continued)

(56) References Cited

U.S. PATENT DOCUMENTS 275,192 A 4/1883 Goodell
286,604 A 10/1883 Goodell (Continued)

FOREIGN PATENT DOCUMENTS

AU 2006201786 A1 11/2007
CN 1989379 A 6/2007

(Continued)

OTHER PUBLICATIONS

European Patent Office, EPO Communication and Partial European Search Report, Application No. 3173618.3-1605 / 2733445, dated Mar. 2 and 9, 2017, 8 pages, The Hague.

(Continued)

*Primary Examiner* — Mohammad M Ali
(74) *Attorney, Agent, or Firm* — Price Heneveld LLP

(57) ABSTRACT

An ice piece release system that includes a chilled compartment set at a temperature below 0° C., a warm section at a temperature above 0° C., and a tray in thermal communication with the chilled compartment. The tray includes a plurality of ice piece-forming receptacles and a cavity in thermal communication with the receptacles. The ice piece release system also includes a primary reservoir assembly in thermal communication with the warm section and fluid communication with the cavity of the tray. The ice piece release system further includes a heat-exchanging fluid having a freezing point below that of water, and the fluid resides in the primary reservoir assembly and the cavity of the tray. The primary reservoir assembly is further adapted to move at least a portion of the heat-exchanging fluid in the reservoir assembly into the cavity.

20 Claims, 8 Drawing Sheets

Related U.S. Application Data continuation of application No. 13/678,879, filed on Nov. 16, 2012, now Pat. No. 8,925,335.

(51) Int. Cl.

| | |
|---|---|
| ***F25C 1/24*** | (2018.01) |
| ***F25C 5/10*** | (2006.01) |
| ***F25C 5/20*** | (2018.01) |
| *F25D 11/02* | (2006.01) |

(52) U.S. Cl.

CPC ..... *F25C 5/22* (2018.01); *F25C 2400/10* (2013.01); *F25C 2600/04* (2013.01); *F25C 2700/12* (2013.01); *F25D 11/02* (2013.01)

(58) Field of Classification Search

CPC .... F25C 2600/04; F25C 2700/12; F25C 1/18; F25B 41/043; F25B 5/02

USPC ..... 62/73, 340

See application file for complete search history.

(56) References Cited

U.S. PATENT DOCUMENTS

| | | | |
|---|---|---|---|
| 301,539 | A | 7/1884 | Vezin |
| 1,407,614 | A | 2/1922 | Wicks |
| 1,616,492 | A | 2/1927 | Lado |
| 1,889,481 | A | 11/1932 | Kennedy, Jr. |
| 1,932,731 | A | 10/1933 | Hathorne |
| 2,027,754 | A | 1/1936 | Smith |
| 2,244,081 | A | 3/1938 | Reeves |
| 2,617,269 | A | 6/1949 | Smith-Johannsen |
| 2,481,525 | A | 9/1949 | Mott |
| 2,757,519 | A | 2/1954 | Sampson |
| 2,846,854 | A | 2/1954 | Galin |
| 2,683,356 | A | 7/1954 | Green, Jr. |
| 2,878,659 | A | 7/1955 | Prance et al. |
| 2,942,432 | A | 6/1960 | Muffly |
| 2,969,654 | A | 1/1961 | Harle |
| 2,996,895 | A | 8/1961 | Lippincott |
| 3,009,336 | A | 11/1961 | Bayston et al. |
| 3,016,719 | A | 1/1962 | Reindl |
| 3,033,008 | A | 5/1962 | Avis |
| 3,046,753 | A | 7/1962 | Carapico, Jr. |
| 3,071,933 | A | 1/1963 | Shoemaker |
| 3,075,360 | A | 1/1963 | Elfving et al. |
| 3,075,364 | A | 1/1963 | Kniffin |
| 3,084,678 | A | 4/1963 | Lindsay |
| 3,084,878 | A | 4/1963 | Helming et al. |
| 3,093,980 | A | 6/1963 | Frei |
| 3,144,755 | A | 8/1964 | Kattis |
| 3,159,985 | A | 12/1964 | Keighley |
| 3,172,269 | A | 3/1965 | Cole |
| 3,192,726 | A | 7/1965 | Newton |
| 3,200,600 | A | 8/1965 | Elfving |
| 3,214,128 | A | 10/1965 | Beck et al. |
| 3,217,508 | A | 11/1965 | Beck et al. |
| 3,217,510 | A | 11/1965 | Knithn et al. |
| 3,217,511 | A | 11/1965 | Keighley |
| 3,222,902 | A | 12/1965 | Brejcha et al. |
| 3,228,222 | A | 1/1966 | Maier |
| 3,255,603 | A | 6/1966 | Johnson |
| 3,306,064 | A | 2/1967 | Poolos |
| 3,308,631 | A | 3/1967 | Kniffin |
| 3,318,105 | A | 5/1967 | Burroughs et al. |
| 3,321,932 | A | 5/1967 | Orphey, Jr. |
| 3,383,876 | A | 5/1968 | Frohbieter |
| 3,412,572 | A | 11/1968 | Kesling |
| 3,426,564 | A | 2/1969 | Jansen et al. |
| 3,451,237 | A | 6/1969 | Baringer et al. |
| 3,638,451 | A | 2/1972 | Brandt |
| 3,646,792 | A | 3/1972 | Hertel et al. |
| 3,648,964 | A | 3/1972 | Fox |
| 3,677,030 | A | 7/1972 | Nicholas |
| 3,684,235 | A | 8/1972 | Schupbach |
| 3,775,992 | A | 12/1973 | Bright |
| 3,788,089 | A | 1/1974 | Graves |
| 3,806,077 | A | 4/1974 | Pietrzak et al. |
| 3,864,933 | A | 2/1975 | Bright |
| 3,892,105 | A | 7/1975 | Bernard |
| 3,908,395 | A | 9/1975 | Hobbs |
| 3,952,539 | A | 4/1976 | Hanson et al. |
| 4,006,605 | A | 2/1977 | Dickson et al. |
| D244,275 | S | 5/1977 | Gurbin |
| 4,024,744 | A | 5/1977 | Trakhtenberg et al. |
| 4,059,970 | A | 11/1977 | Loeb |
| 4,062,201 | A | 12/1977 | Schumacher et al. |
| 4,078,450 | A | 3/1978 | Vallejos |
| D249,269 | S | 9/1978 | Pitts |
| 4,142,378 | A | 3/1979 | Bright et al. |
| 4,148,457 | A | 4/1979 | Gurbin |
| 4,184,339 | A | 1/1980 | Wessa |
| 4,222,547 | A | 9/1980 | Lalonde |
| 4,261,182 | A | 4/1981 | Elliott |
| 4,288,497 | A | 9/1981 | Tanaka et al. |
| 4,402,185 | A | 9/1983 | Perchak |
| 4,402,194 | A | 9/1983 | Kuwako et al. |
| 4,412,429 | A | 11/1983 | Kohl |
| 4,462,345 | A | 7/1984 | Routery |
| 4,483,153 | A | 11/1984 | Wallace |
| 4,487,024 | A | 12/1984 | Fletcher et al. |
| 4,550,575 | A | 11/1985 | DeGaynor |
| 4,562,991 | A | 1/1986 | Wu |
| 4,587,810 | A | 5/1986 | Fletcher |
| 4,627,946 | A | 12/1986 | Crabtree |
| 4,669,271 | A | 6/1987 | Noel |
| 4,680,943 | A | 7/1987 | Mawby et al. |
| 4,685,304 | A | 8/1987 | Essig |
| 4,688,386 | A | 8/1987 | Lane et al. |
| 4,727,720 | A | 3/1988 | Wernicki |
| 4,843,827 | A | 7/1989 | Peppers |
| 4,852,359 | A | 8/1989 | Manzotti |
| 4,856,463 | A | 8/1989 | Johnston |
| 4,910,974 | A | 3/1990 | Hara |
| 4,942,742 | A | 7/1990 | Burruel |
| 4,970,877 | A | 11/1990 | Dimijian |
| 4,971,737 | A | 11/1990 | Infanti |
| 5,025,756 | A | 6/1991 | Nyc |
| D318,281 | S | 7/1991 | McKinlay |
| 5,044,600 | A | 9/1991 | Shannon |
| 5,129,237 | A | 7/1992 | Day et al. |
| 5,157,929 | A | 10/1992 | Hotaling |
| 5,177,980 | A | 1/1993 | Kawamoto et al. |
| 5,196,127 | A | 3/1993 | Solell |
| 5,253,487 | A | 10/1993 | Oike |
| 5,257,601 | A | 11/1993 | Coffin |
| 5,272,888 | A | 12/1993 | Fisher et al. |
| 5,372,492 | A | 12/1994 | Yamauchi |
| 5,378,521 | A | 1/1995 | Ogawa et al. |
| 5,400,605 | A | 3/1995 | Jeong |
| 5,408,844 | A | 4/1995 | Stokes |
| 5,425,243 | A | 6/1995 | Sanuki et al. |
| 5,483,929 | A | 1/1996 | Kuhn et al. |
| 5,586,439 | A | 12/1996 | Schlosser et al. |
| 5,617,728 | A | 4/1997 | Kim et al. |
| 5,632,936 | A | 5/1997 | Su et al. |
| 5,618,463 | A | 8/1997 | Rindler et al. |
| 5,675,975 | A | 10/1997 | Lee |
| 5,761,920 | A | 6/1998 | Wilson et al. |
| 5,768,900 | A | 6/1998 | Lee |
| 5,826,320 | A | 10/1998 | Rathke et al. |
| 5,884,487 | A | 3/1999 | Davis et al. |
| 5,884,490 | A | 3/1999 | Whidden |
| D415,505 | S | 10/1999 | Myers |
| 5,970,725 | A | 10/1999 | Lee |
| 5,970,735 | A | 10/1999 | Hobelsberger |
| 6,058,720 | A | 5/2000 | Ryu |
| 6,062,036 | A | 5/2000 | Hobelsberger |
| 6,101,817 | A | 8/2000 | Watt |
| 6,145,320 | A | 11/2000 | Kim |
| 6,148,620 | A | 11/2000 | Kumagai et al. |
| 6,148,621 | A | 11/2000 | Byczynski et al. |
| 6,161,390 | A | 12/2000 | Kim |
| 6,179,045 | B1 | 1/2001 | Lilleaas |

(56) References Cited

U.S. PATENT DOCUMENTS 6,209,849 B1 4/2001 Dickmeyer
6,282,909 B1 9/2001 Newman et al.
6,289,683 B1 9/2001 Daukas et al.
6,357,720 B1 3/2002 Shapiro et al.
6,425,259 B2 7/2002 Nelson et al.
6,427,463 B1 8/2002 James
6,438,988 B1 8/2002 Paskey
6,467,146 B1 10/2002 Herman
6,481,235 B2 11/2002 Kwon
6,488,463 B1 12/2002 Harris
6,598,417 B1 * 7/2003 Wilkes ..... B67D 1/0861 222/146.6
6,647,739 B1 11/2003 Kim et al.
6,688,130 B1 2/2004 Kim
6,688,131 B1 2/2004 Kim et al.
6,735,959 B1 5/2004 Najewicz
6,742,351 B2 6/2004 Kim et al.
6,763,787 B2 7/2004 Hallenstvedt et al.
6,782,706 B2 8/2004 Holmes et al.
D496,374 S 9/2004 Zimmerman
6,817,200 B2 11/2004 Marty et al.
6,820,433 B2 11/2004 Hwang
6,857,277 B2 2/2005 Somura
6,914,043 B1 * 7/2005 Chapman ..... A23G 9/38 435/69.1
6,935,124 B2 8/2005 Takahashi et al.
6,951,113 B1 10/2005 Adamski
D513,019 S 12/2005 Lion et al.
7,010,934 B2 3/2006 Choi et al.
7,010,937 B2 3/2006 Wilkinson et al.
7,013,654 B2 3/2006 Tremblay et al.
7,051,541 B2 5/2006 Chung et al.
7,059,140 B2 6/2006 Zevlakis
7,062,925 B2 6/2006 Tsuchikawa et al.
7,062,936 B2 6/2006 Rand et al.
7,082,782 B2 8/2006 Schlosser et al.
7,131,280 B2 11/2006 Voglewede et al.
7,185,508 B2 3/2007 Voglewede et al.
7,188,479 B2 3/2007 Anselmino et al.
7,201,014 B2 4/2007 Hornung
7,204,092 B2 4/2007 Castrellón et al.
7,210,298 B2 5/2007 Lin
7,216,490 B2 5/2007 Joshi
7,216,491 B2 5/2007 Cole et al.
7,234,423 B2 6/2007 Lindsay
7,266,973 B2 9/2007 Anderson et al.
7,297,516 B2 11/2007 Chapman et al.
7,318,323 B2 1/2008 Tatsui et al.
7,386,993 B2 6/2008 Castrellon et al.
7,415,833 B2 8/2008 Leaver et al.
7,448,863 B2 11/2008 Yang
7,469,553 B2 12/2008 Wu et al.
7,487,645 B2 2/2009 Sasaki et al.
7,568,359 B2 8/2009 Wetekamp et al.
7,587,905 B2 9/2009 Kopf
7,614,244 B2 11/2009 Venkatakrishnan et al.
7,669,435 B2 3/2010 Joshi
7,681,406 B2 3/2010 Cushman et al.
7,703,292 B2 4/2010 Cook et al.
7,707,847 B2 5/2010 Davis et al.
7,744,173 B2 6/2010 Maglinger et al.
7,752,859 B2 7/2010 Lee et al.
7,762,092 B2 7/2010 Tikhonov et al.
7,802,457 B2 9/2010 Golovashchenko et al.
7,832,220 B1 * 11/2010 Wiggs ..... F24J 3/083 62/260
7,832,227 B2 11/2010 Wu et al.
7,866,167 B2 1/2011 Kopf
7,918,105 B2 4/2011 Kim
7,963,120 B2 6/2011 An et al.
8,015,849 B2 9/2011 Jones et al.
8,037,697 B2 10/2011 LeClear et al.
8,074,464 B2 12/2011 Venkatakrishnan et al.
8,099,989 B2 1/2012 Bradley et al.
8,104,304 B2 1/2012 Kang et al.
8,117,863 B2 2/2012 Van Meter et al.
8,171,744 B2 5/2012 Watson et al.
8,196,427 B2 6/2012 Bae et al.
8,281,613 B2 10/2012 An et al.
8,322,148 B2 12/2012 Kim et al.
8,336,327 B2 12/2012 Cole et al.
8,371,133 B2 2/2013 Kim et al.
8,371,136 B2 2/2013 Venkatakrishnan et al.
8,375,919 B2 2/2013 Cook et al.
8,408,023 B2 4/2013 Shin et al.
8,413,619 B2 4/2013 Cleeves
8,424,334 B2 4/2013 Kang et al.
8,429,926 B2 4/2013 Shaha et al.
8,474,279 B2 7/2013 Besore et al.
8,516,835 B2 8/2013 Holler
8,516,846 B2 8/2013 Lee et al.
8,555,658 B2 10/2013 Kim et al.
8,616,018 B2 12/2013 Jeong et al.
8,646,283 B2 2/2014 Kuratani et al.
8,677,774 B2 3/2014 Yamaguchi et al.
8,746,204 B2 6/2014 Hofbauer
8,756,952 B2 6/2014 Adamski et al.
8,769,981 B2 7/2014 Hong et al.
8,820,108 B2 9/2014 Oh et al.
8,893,523 B2 11/2014 Talegaonkar et al.
8,925,335 B2 1/2015 Gooden et al.
8,943,852 B2 2/2015 Lee et al.
9,010,145 B2 4/2015 Lim et al.
9,127,873 B2 9/2015 Tarr et al.
9,140,472 B2 9/2015 Shin et al.
9,217,595 B2 12/2015 Kim et al.
9,217,596 B2 12/2015 Hall
9,476,631 B2 10/2016 Park et al.
2002/0014087 A1 2/2002 Kwon
2003/0111028 A1 6/2003 Hallenstvedt
2004/0099004 A1 5/2004 Somura
2004/0144100 A1 7/2004 Hwang
2004/0206250 A1 10/2004 Kondou et al.
2004/0237566 A1 12/2004 Hwang
2004/0261427 A1 12/2004 Tsuchikawa et al.
2005/0067406 A1 3/2005 Rajarajan et al.
2005/0126185 A1 6/2005 Joshi
2005/0126202 A1 6/2005 Shoukyuu et al.
2005/0151050 A1 7/2005 Godfrey
2005/0160741 A1 7/2005 Park
2005/0160757 A1 7/2005 Choi et al.
2006/0016209 A1 1/2006 Cole et al.
2006/0032262 A1 2/2006 Seo et al.
2006/0053805 A1 3/2006 Flinner et al.
2006/0086107 A1 4/2006 Voglewede et al.
2006/0086134 A1 4/2006 Voglewede et al.
2006/0150645 A1 7/2006 Leaver
2006/0168983 A1 8/2006 Tatsui et al.
2006/0207282 A1 9/2006 Visin et al.
2006/0225457 A1 10/2006 Hallin
2006/0233925 A1 10/2006 Kawamura
2006/0242971 A1 11/2006 Cole et al.
2006/0288726 A1 12/2006 Mori et al.
2007/0028866 A1 2/2007 Lindsay
2007/0107447 A1 5/2007 Langlotz
2007/0119202 A1 5/2007 Kadowaki et al.
2007/0130983 A1 6/2007 Broadbent et al.
2007/0137241 A1 6/2007 Lee et al.
2007/0193278 A1 8/2007 Polacek et al.
2007/0227162 A1 10/2007 Wang
2007/0227164 A1 10/2007 Ito et al.
2007/0262230 A1 11/2007 McDermott
2008/0034780 A1 2/2008 Lim et al.
2008/0104991 A1 5/2008 Hoehne et al.
2008/0145631 A1 6/2008 Bhate et al.
2008/0236187 A1 10/2008 Kim
2008/0264082 A1 10/2008 Tikhonov et al.
2008/0289355 A1 11/2008 Kang et al.
2009/0049858 A1 2/2009 Lee et al.
2009/0120306 A1 5/2009 DeCarlo et al.
2009/0165492 A1 7/2009 Wilson et al.
2009/0173089 A1 7/2009 LeClear et al.
2009/0178430 A1 7/2009 Jendrusch et al.
2009/0187280 A1 7/2009 Hsu et al.

(56) References Cited

U.S. PATENT DOCUMENTS

| | | | |
|---|---|---|---|
| 2009/0199569 | A1 | 8/2009 | Petrenko |
| 2009/0211266 | A1 | 8/2009 | Kim et al. |
| 2009/0211271 | A1 | 8/2009 | Kim et al. |
| 2009/0223230 | A1 | 9/2009 | Kim et al. |
| 2009/0235674 | A1 | 9/2009 | Kern et al. |
| 2009/0272259 | A1 | 11/2009 | Cook et al. |
| 2009/0308085 | A1 | 12/2009 | DeVos |
| 2010/0011827 | A1 | 1/2010 | Stoeger et al. |
| 2010/0018226 | A1 | 1/2010 | Kim et al. |
| 2010/0031675 | A1 | 2/2010 | Kim et al. |
| 2010/0043455 | A1 | 2/2010 | Kuehl et al. |
| 2010/0050663 | A1 | 3/2010 | Venkatakrishnan et al. |
| 2010/0050680 | A1 | 3/2010 | Venkatakrishnan et al. |
| 2010/0055223 | A1 | 3/2010 | Kondou et al. |
| 2010/0095692 | A1 | 4/2010 | Jendrusch et al. |
| 2010/0101254 | A1 | 4/2010 | Besore et al. |
| 2010/0126185 | A1 | 5/2010 | Cho et al. |
| 2010/0139295 | A1 | 6/2010 | Zuccolo et al. |
| 2010/0163707 | A1 | 7/2010 | Kim |
| 2010/0180608 | A1 | 7/2010 | Shaha et al. |
| 2010/0197849 | A1 | 8/2010 | Momose et al. |
| 2010/0218518 | A1 | 9/2010 | Ducharme et al. |
| 2010/0218540 | A1 | 9/2010 | McCollough et al. |
| 2010/0218542 | A1 | 9/2010 | McCollough et al. |
| 2010/0251730 | A1 | 10/2010 | Whillock, Sr. |
| 2010/0257888 | A1 | 10/2010 | Kang et al. |
| 2010/0293969 | A1 | 11/2010 | Braithwaite et al. |
| 2010/0313594 | A1 | 12/2010 | Lee et al. |
| 2010/0319367 | A1 | 12/2010 | Kim et al. |
| 2010/0326093 | A1 | 12/2010 | Watson et al. |
| 2011/0005263 | A1 | 1/2011 | Yamaguchi et al. |
| 2011/0023502 | A1 | 2/2011 | Ito et al. |
| 2011/0062308 | A1 | 3/2011 | Hammond et al. |
| 2011/0146312 | A1 | 6/2011 | Hong et al. |
| 2011/0192175 | A1 | 8/2011 | Kuratani et al. |
| 2011/0214447 | A1 | 9/2011 | Bortoletto et al. |
| 2011/0239686 | A1 | 10/2011 | Zhang et al. |
| 2011/0265498 | A1 | 11/2011 | Hall |
| 2012/0007264 | A1 | 1/2012 | Kondou et al. |
| 2012/0011868 | A1 | 1/2012 | Kim et al. |
| 2012/0023996 | A1 | 2/2012 | Herrera et al. |
| 2012/0047918 | A1 | 3/2012 | Herrera et al. |
| 2012/0073538 | A1 | 3/2012 | Hofbauer |
| 2012/0085302 | A1 | 4/2012 | Cleeves |
| 2012/0174613 | A1 | 7/2012 | Park et al. |
| 2012/0240613 | A1 | 9/2012 | Saito et al. |
| 2012/0291473 | A1 | 11/2012 | Krause et al. |
| 2013/0276468 | A1 | 10/2013 | Buehrle et al. |
| 2016/0370078 | A1 | 12/2016 | Koo |
| 2017/0074527 | A1 | 3/2017 | Visin |
| 2017/0191722 | A1 | 7/2017 | Bertolini et al. |
| 2017/0241694 | A1 | 8/2017 | Ji et al. |
| 2017/0307281 | A1 | 10/2017 | Morgan et al. |
| 2017/0314841 | A1 | 11/2017 | Koo et al. |
| 2018/0017306 | A1 | 1/2018 | Miller |

FOREIGN PATENT DOCUMENTS

| | | | |
|---|---|---|---|
| CN | 102353193 | A | 9/2011 |
| DE | 202006012499 | U1 | 10/2006 |
| DE | 102008042910 | A1 | 4/2010 |
| DE | 102009046030 | | 4/2011 |
| EP | 1653171 | | 5/2006 |
| EP | 1821051 | A1 | 8/2007 |
| EP | 2078907 | A2 | 7/2009 |
| EP | 2375200 | | 10/2011 |
| EP | 2444761 | A2 | 4/2012 |
| EP | 2660541 | | 11/2013 |
| EP | 2743608 | A2 | 6/2014 |
| FR | 2771159 | A1 | 5/1999 |
| GB | 657353 | A | 9/1951 |
| GB | 2139337 | A | 11/1984 |
| JP | S60141239 | A | 7/1985 |
| JP | 6171877 | | 5/1986 |
| JP | H01196478 | A | 8/1989 |
| JP | H01210778 | A | 8/1989 |
| JP | H01310277 | A | 12/1989 |
| JP | H024185 | A | 1/1990 |
| JP | H0231649 | A | 2/1990 |
| JP | H02143070 | A | 6/1990 |
| JP | H03158670 | A | 7/1991 |
| JP | H03158673 | A | 7/1991 |
| JP | H0415069 | A | 1/1992 |
| JP | H04161774 | A | 6/1992 |
| JP | H4260764 | A | 9/1992 |
| JP | H051870 | A | 1/1993 |
| JP | H05248746 | A | 9/1993 |
| JP | H05332562 | A | 12/1993 |
| JP | H063005 | A | 1/1994 |
| JP | H0611219 | A | 1/1994 |
| JP | H06323704 | A | 11/1994 |
| JP | H10227547 | A | 8/1998 |
| JP | H10253212 | A | 9/1998 |
| JP | H11223434 | A | 8/1999 |
| JP | 2000039240 | A | 2/2000 |
| JP | 2000346506 | A | 12/2000 |
| JP | 2001041620 | A | 2/2001 |
| JP | 2001041624 | A | 2/2001 |
| JP | 2001221545 | A | 8/2001 |
| JP | 2001355946 | | 12/2001 |
| JP | 2002139268 | A | 5/2002 |
| JP | 2002295934 | A | 10/2002 |
| JP | 2002350019 | A | 12/2002 |
| JP | 2003042612 | A | 2/2003 |
| JP | 2003042621 | A | 2/2003 |
| JP | 2003172564 | A | 6/2003 |
| JP | 2003232587 | A | 8/2003 |
| JP | 2003269830 | A | 9/2003 |
| JP | 2003279214 | A | 10/2003 |
| JP | 2003336947 | A | 11/2003 |
| JP | 2004053036 | A | 2/2004 |
| JP | 2004278894 | A | 10/2004 |
| JP | 2004278990 | A | 10/2004 |
| JP | 2005164145 | A | 6/2005 |
| JP | 2005180825 | A | 7/2005 |
| JP | 2005195315 | A | 7/2005 |
| JP | 2005331200 | A | 12/2005 |
| JP | 2006022980 | A | 1/2006 |
| JP | 2006071247 | A | 3/2006 |
| JP | 2006323704 | A | 11/2006 |
| JP | 2007232336 | A | 9/2007 |
| JP | 4333202 | B2 | 9/2009 |
| KR | 20010109256 | A | 12/2001 |
| KR | 20060013721 | A | 2/2006 |
| KR | 20060126156 | A | 12/2006 |
| KR | 100845860 | B1 | 7/2008 |
| KR | 20100123089 | A | 11/2010 |
| KR | 20110037609 | A | 4/2011 |
| RU | 2365832 | | 8/2009 |
| SU | 1747821 | A1 | 7/1992 |
| TW | 424878 | U | 3/2001 |
| WO | 8808946 | A1 | 11/1988 |
| WO | 2008052736 | A1 | 5/2008 |
| WO | 2008056957 | A2 | 5/2008 |
| WO | 2008061179 | A2 | 5/2008 |
| WO | 2008143451 | A1 | 11/2008 |
| WO | 2012002761 | A2 | 1/2012 |
| WO | 2012025369 | | 3/2012 |

OTHER PUBLICATIONS

European Search Report dated Mar. 10, 2015, Patent No. 2,784,415; pp. 1-6.

European Search Report dated Mar. 10, 2015, Patent No. 2,784,416; pp. 1-7.

European Searching Authority, European Search Report and Opinion for Application No. EP13194691.5, dated Mar. 10, 2015; pp. 1-7.

European Searching Authority, European Search Report and Opinion for Application No. P13194682.4, dated Jul. 15, 2015, 12 pages.

(56) References Cited

OTHER PUBLICATIONS

European Patent Office; European Search Report for Application No. 13163180.6 dated Sep. 18, 2017; 8 pages; The Netherlands.

* cited by examiner

ICE CUBE RELEASE AND RAPID FREEZE USING FLUID EXCHANGE APPARATUS

CROSS-REFERENCE TO RELATED APPLICATIONS

This application is a continuation that claims the benefit under 35 U.S.C. § 120 of U.S. patent application Ser. No. 14/551,157, filed on Nov. 24, 2014, now issued as U.S. Pat. No. 9,534,824, entitled "ICE CUBE RELEASE AND RAPID FREEZE USING FLUID EXCHANGE APPARATUS AND METHODS," which is a continuation of U.S. patent application Ser. No. 13/678,879, filed on Nov. 16, 2012, entitled "ICE CUBE RELEASE AND RAPID FREEZE USING FLUID EXCHANGE APPARATUS AND METHODS," now issued as U.S. Pat. No. 8,925,335, the entire disclosures of which are hereby incorporated by reference in their entirety.

TECHNICAL FIELD

The disclosure relates to ice piece formation and harvesting in appliances, particularly refrigeration appliances.

BACKGROUND

Ice piece formation and harvesting in refrigeration appliances involves significant energy usage relative to the energy usage of other appliance components, such as interior lighting, compressor operation, etc. Formation of ice pieces in ice trays from water in a liquid phase often involves thermally inefficient processes, e.g., convection. Water is introduced into the tray, and then the water is cooled below the freezing point within the ice making compartment by convective processes. Under most, non-conductive conditions, these freezing processes are slow and can require significant energy usage.

Similarly, release of ice pieces from the tray consumes significant energy. For appliances with automatic ice makers, the appliance must overcome the adhesion forces between the ice piece and the tray to harvest the ice pieces once formed. Mechanical approaches are often successful in grossly removing the pieces (e.g., twisting), but frequently the ice piece quality suffers from ice piece fractures away from the ice piece/tray interfaces. One energy-intensive approach for releasing ice pieces from trays with clean, fractureless surfaces is to locally impart energy in the form of heat to the tray/ice piece interface. Although this approach is usually successful in producing good quality ice pieces, it relies on high energy usage—i.e., electrical energy to drive resistive heating elements. Further, the heat and mechanical movement associated with these approaches may also cause cracking or even fracturing of the ice pieces.

BRIEF SUMMARY

One aspect of the disclosure is to provide an ice piece release system that includes a chilled compartment set at a temperature below 0° C.; a warm section set at a temperature above 0° C.; a tray in thermal communication with the chilled compartment, the tray having a plurality of ice piece-forming receptacles and a cavity in thermal communication with the receptacles; a primary reservoir assembly in thermal communication with the warm section and fluid communication with the cavity of the tray; and a heat-exchanging fluid having a freezing point below that of water. The primary reservoir assembly further comprises at least one chamber, each chamber in fluid communication with the cavity of the tray. The fluid resides in one or more of the cavity and the at least one chamber. The primary reservoir assembly is adapted to move heat-exchanging fluid in the at least one chamber into the cavity.

Another aspect of the disclosure is to provide an ice piece release system, that includes a chilled compartment set at a temperature below 0° C.; a warm section set at a temperature above 0° C.; a tray in thermal communication with the chilled compartment, the tray having a plurality of ice piece-forming receptacles and a cavity in thermal communication with the receptacles; a primary reservoir assembly in thermal communication with the warm section and fluid communication with the cavity of the tray; and a heat-exchanging fluid having a freezing point below that of water. The fluid resides in one or more of the cavity and the primary reservoir assembly. The primary reservoir assembly is adapted to move heat-exchanging fluid in the reservoir assembly into the cavity by the force of gravity.

A further aspect of the disclosure is to provide an ice piece tray assembly that includes a plurality of ice piece-forming receptacles; a cavity in thermal communication with the receptacles; and a membrane that separates the cavity from the receptacles. The cavity is configured to receive a heat exchanging fluid to aid in the release of ice pieces that are formed in the receptacles.

These and other features, advantages, and objects of the disclosure will be further understood and appreciated by those skilled in the art by reference to the following specification, claims, and appended drawings.

DETAILED DESCRIPTION

For purposes of description herein, the aspects of this disclosure may assume various alternative orientations, except where expressly specified to the contrary. The specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
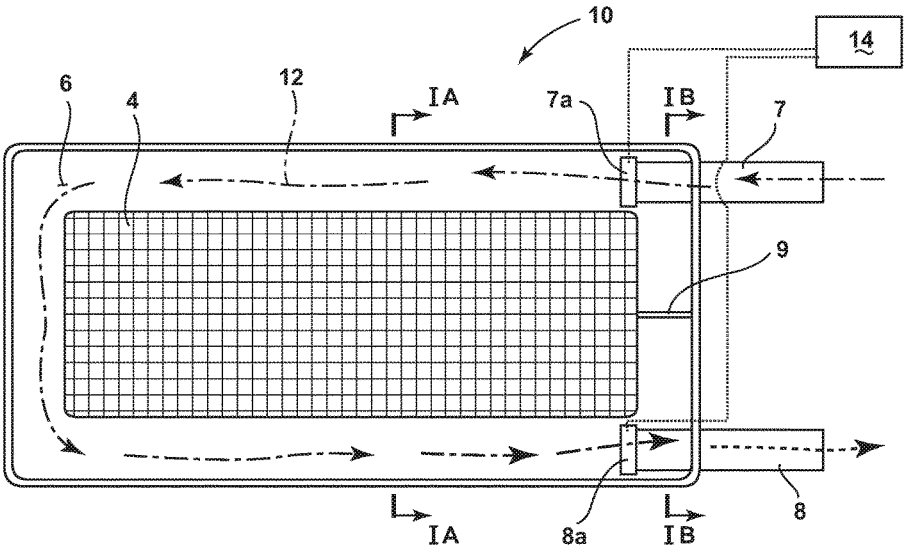
FIG. 1 is a plan view of an ice piece tray according to one aspect of the disclosure.
Figure 1A:
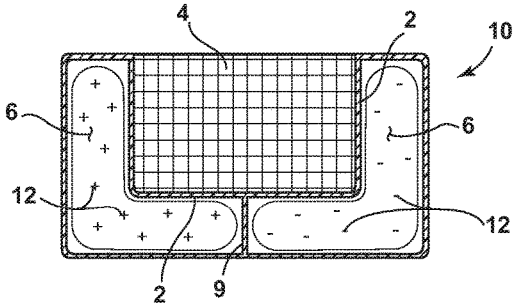
FIG. 1A is a cross-sectional view of the ice piece tray depicted in FIG. 1.
Figure 1B:
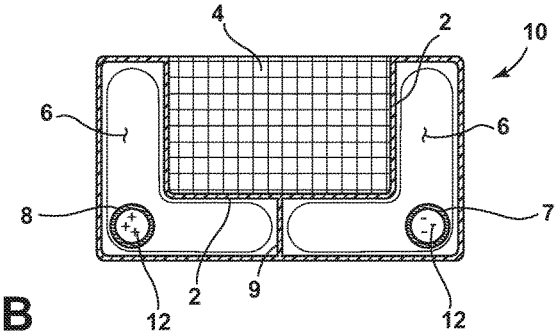
FIG. 1B is a second cross-sectional view of the ice piece tray depicted in FIG. 1.

Referring to FIGS. 1, 1A and 1B, an ice piece tray 10 is shown with a plurality of ice piece receptacles 4 according to an aspect of the disclosure. The tray 10 includes a cavity 6 in thermal communication with the receptacles 4. A membrane 2 separates the cavity 6 from the receptacles 4. Water (not shown) dispensed into receptacles 4 may freeze into ice pieces (not shown) when tray 10 is subjected to an environment below 0° C. for a time sufficient for the phase change. Once ice pieces are formed in receptacles 4, they may be released by mechanical action of the tray 10. For example, tray 10 may be twisted, vibrated, rotated, compressed or bent to facilitate removal of the ice pieces (not shown). Alternatively, tray 10 may be fitted with an ejector assembly or rake (not shown) to mechanically press and harvest the ice pieces from the receptacles 4. Once ice pieces have been separated from the receptacles 4, tray 10 can then be rotated or tilted to drop the ice pieces into a container (not shown).

As more clearly shown in the cross-sections of the tray 10 (see FIGS. 1A and 1B), cavity 6 is configured in direct thermal communication with receptacles 4. Accordingly, heat exchanging fluid 12 within cavity 6 can conduct heat to and from receptacles 4 through the membrane 2. Heat exchange between heat exchanging fluid 12, receptacles 4 and membrane 2 is governed by many factors, including the thermal conductivity and dimensions of these elements. Tray 10, receptacles 4 and membrane 2, for example, may be fabricated from food-safe thermoplastics, elastomers, aluminum or stainless steel alloys with high thermal conductivity. The shape of the receptacles 4 is governed by the desired ice piece shape, fatigue resistance and the mechanical design approach for release and harvesting of the ice pieces. As shown in FIG. 1, the receptacles 4 may be shaped to produce cube-shaped ice pieces.

Membrane 2 can be configured with sufficient thickness to allow for mechanical action to the tray 10 to release ice pieces. In particular, the thickness of membrane 2 may be increased to reduce the risk of premature fatigue-related failure from mechanical cycling of the tray 10 to release and harvest ice pieces. On the other hand, a reduced thickness of membrane 2 improves the thermal conduction between the receptacles 4 and heat exchanging fluid 12.

As for the heat exchanging fluid 12, it must have a freezing point below that of water. Hence, under most atmospheric conditions, the heat exchanging fluid should not freeze at or near the freezing point of water, 0° C. Heat exchanging fluid 12 may include water and food-safe additives to depress the freezing point of the fluid (e.g., propylene glycol, glycerol, and others). Heat exchanging fluid 12 should also possess a high thermal conductivity.

As shown in FIG. 1 (and cross-sectional views FIGS. 1A and 1B), tray 10 is configured to accommodate flow of heat exchanging fluid 12 within cavity 6. Heat exchanging fluid 12 may enter cavity 6 through fluid port 7 and valve 7*a*. The heat exchanging fluid 12 can then travel through cavity 6, around receptacles 4, and out of tray 10 via valve 8*a* and port 8. Divider 9, as shown in FIG. 1, is situated between ports 7 and 8 and prevents back flow of heat exchanging fluid 12 directly between the ports 7 and 8 that would bypass the cavity 6. Accordingly, divider 9 encourages flow of heat exchanging fluid 12 clockwise (from port 7 to port 8) or counter-clockwise (from port 8 to port 7) through cavity 6.

The flow of heat exchanging fluid 12, whether clockwise or counterclockwise, through cavity 6 can conduct heat to/from heat exchanging fluid 12 and water (not shown) residing in receptacles 4. Various parameters govern this heat conduction: thermal conductivities of the tray 10 and heat exchanging fluid 12, flow rates for fluid 12 and temperature differences between the fluid 12 and water residing in receptacles 4. For example, heat exchanging fluid 12 at a temperature well below 0° C. that flows through cavity 6 can increase the rate of ice formation in receptacles 4. Fluid 12 does this by extracting heat from water residing in receptacles 4 at a relatively warmer temperature (above the temperature of fluid 12). As another example, heat exchanging fluid 12 at a temperature above 0° C. that flows through cavity 6 can assist in the release of ice pieces formed in receptacles 4. In this scenario, fluid 12 transfers heat to the interface between the receptacles 4 and ice pieces (not shown) residing in the receptacles 4. Heat conducted in this fashion breaks the bond between the ice pieces and the walls of the receptacles 4 by locally melting the ice at this interface.

Flow of heating exchanging fluid 12 is controlled in part by valves 7*a* and 8*a*, corresponding to ports 7 and 8, respectively. Valves 7*a* and 8*a* may be connected to a controller 14 that functions to control the operation of valves 7*a* and 8*a*. Various known microprocessor-based controllers are suitable for this purpose. Valves 7*a* and 8*a* may be two-way (open/closed) or variable position-type valves. Depending on the configuration of valves 7*a* and 8*a* by controller 14, for example, heat exchanging fluid 12 can be caused to flow into cavity 6 through one of the ports 7 and 8 and then fill the cavity 6. For example, valve 7*a* may be set in an open position and valve 8*a* set in a closed position to effectuate filling of cavity 6 by heat exchanging fluid 12. Ultimately, the operation of valves 7*a* and 8*a* can be used to assist in the formation and release of ice pieces within receptacles 4 via flow of heat exchanging fluid 12 within cavity 6 of tray 10.

Figure 2:
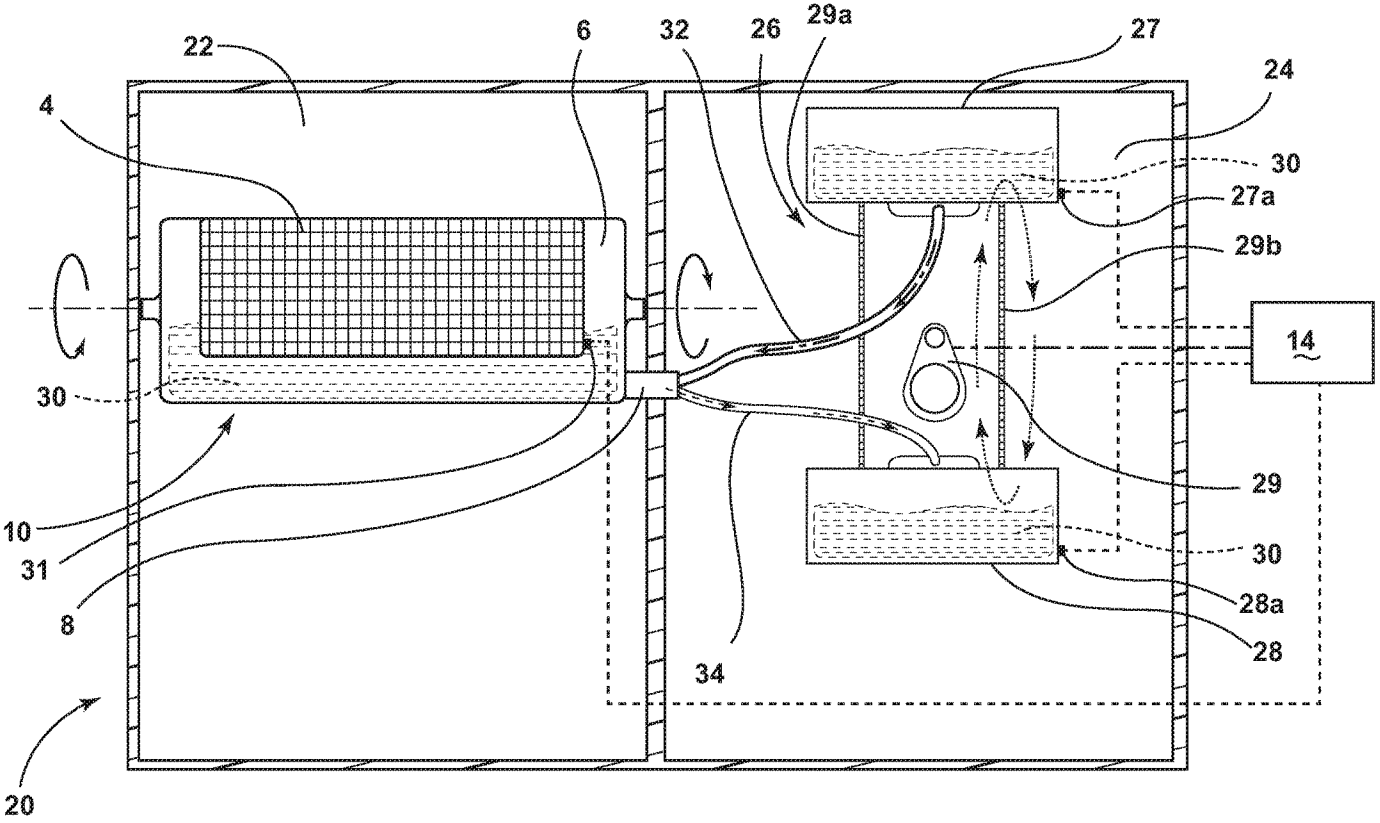
FIG. 2 is a side-view schematic of an ice piece release and formation system according to another aspect of the disclosure.

Ice piece release and formation system 20, according to another aspect of the disclosure, is depicted schematically in FIG. 2. System 20 includes a warm section 24 at a temperature above 0° C., and a chilled compartment 22 set at a temperature below 0° C. System 20 further includes a tray 10 (see FIGS. 1, 1A, 1B) in thermal communication with the chilled compartment 22. The tray 10 includes a plurality of ice piece-forming receptacles 4 and a cavity 6 in thermal communication with the receptacles 4. Water may be dispensed into receptacles 4 with dispensing apparatus (not shown). Ice pieces formed in receptacles 4 may be released from these receptacles with a twisting and flexing motion as depicted in FIG. 2 (i.e., one end of tray 10 is rotated in a particular direction while the other end of tray 10 is held fixed, or is rotated in the opposite direction). Ice harvesting apparatus can engage tray 10 for this purpose, and a container (not shown) arranged beneath tray 10 can capture ice pieces released from receptacles 4.

System 20 also includes a primary reservoir assembly 26, coupled to the tray 10. Primary reservoir assembly 26 is located in thermal communication with the warm section 24, and includes a first chamber 27 and a second chamber 28. Both chambers 27 and 28 are in fluid communication with tray 10. One or both chambers 27 and 28 may be provided with thermal insulation. In particular, a fluid line 32 couples chamber 27 to tray 10 via port 7 (not shown). Similarly, a fluid line 34 couples chamber 28 to tray 10 via port 8 (see FIG. 2). Primary reservoir assembly 26 also includes a driving body 29, configured to move chambers 27 and 28 to positions above and beneath the level of tray 10. Chambers 27 and 28 may be moved in synchrony with one another by driving body 29, or they may be configured for independent movement. As schematically depicted in FIG. 2, driving body 29 is configured in a screw-drive arrangement with chambers 27 and 28. In particular, rotational motion of driving body 29 drives rotation of shafts 29*a* and 29*b*, thus producing up and down motion of chambers 27 and 28 (see also FIGS. 3 and 3A). Driving body 29 may also possess various configurations of motors, gearing and other known apparatus for accomplishing these functions.

As also shown in FIG. 2, system 20 is depicted with heat exchanging fluid 30 residing in chamber 27, chamber 28 and cavity 6 of tray 10. Heat exchanging fluid 30 can flow from chamber 27, or chamber 28, into cavity 6 of tray 10, depending on the vertical position of these chambers relative to the cavity 6. For example, heat exchanging fluid 30 in chamber 27 can flow into cavity 6 at least in part by the force of gravity via fluid line 32 when chamber 27 is located above cavity 6. Heat exchanging fluid 30 in chamber 28 can also flow into cavity 6 at least in part by the force of gravity via fluid line 34 when chamber 28 is located above cavity 6. Likewise, heat exchanging fluid 30 residing in cavity 6 can flow into chamber 28 via fluid line 34 at least in part by the force of gravity when chamber 28 is located beneath cavity 6. Further, heat exchanging fluid 30 residing in cavity 6 can flow via fluid line 32 into chamber 27 at least in part by the force of gravity when chamber 27 is located beneath cavity 6.

Controller 14 can effectuate such flow to and from cavity 6 by the operation of valves 7*a* and 8*a* (see FIG. 1). Similarly, controller 14 can also effectuate such flow of heat exchanging fluid 30 to and from cavity 6 and the chambers 27 and 28 by controlling the operation of driving body 29 (see FIG. 2). Consequently, controller 14 can control the flow of heat exchanging fluid 30 within system 20 by the operation of valve 7*a*, valve 8*a*, and driving body 29.

Controller 14 may also be coupled to a temperature sensor 31, arranged in thermal communication with cavity 6 and receptacles 4 (see FIG. 2). Controller 14 could also be connected to temperature sensors 27*a* and 28*a*, arranged in thermal communication with chambers 27 and 28, respectively. Temperature sensors 27*a*, 28*a*, and 31 could be of an analog bi-metal, variable output thermistor type, or other known temperature sensor suitable for assessing the temperature of heat exchanging fluid 30, cavity 6 and receptacles 4. Controller 14 can use the temperature-related data from sensors 27*a*, 28*a*, and/or 31 to effect control of driving body 29, valve 7*a* and valve 8*a* for the purpose of directing heat exchanging fluid 30 within system 20.

Alternatively, temperature sensors 27*a*, 28*a*, and/or 31 can be configured as an analog bi-metal type sensor, and arranged within system 20 to energize circuits associated with valves 7*a*, 8*a* and driving body 29 (not shown). When configured in this fashion, controller 14 could be removed from system 20. Depending on the temperature measured by sensors 27*a*, 28*a* and/or 31, these sensors can be set to close circuits associated with valves 7*a*, 8*a* and driving body 29, thereby directing flow of heat exchanging fluid 30 within system 20 as described earlier. In this configuration without controller 14, system 20 is greatly simplified, resulting in lower cost. Advantageously, this ice piece release and formation system 20, as-configured with analog temperature sensors, may be installed into an appliance that lacks a microprocessor-based controller 14.

It should also be understood that the flow of heat exchanging fluid 30 from a chamber 27 or 28, located above cavity 6, can displace heat exchanging fluid 30 residing in cavity 6. Heat exchanging fluid 30 displaced from cavity 6 in this manner can flow into the other chamber (either chamber 27 or 28), located below cavity 6. In this fashion, heat exchanging fluid 30 existing at a temperature different than the heat exchanging fluid 30 in cavity 6 can change the heat conduction dynamics between the fluid 30 and receptacles 4 of tray 10.

For example, heat exchanging fluid 30 still residing in cavity 6 for a period of time during formation of ice pieces in receptacles 4 of tray 10 will eventually reach the temperature of chilled compartment 22—a temperature below 0° C. This 'cold' heat exchanging fluid 30 in cavity 6 can be displaced by 'warm' heat exchanging fluid 30 located in chamber 27 (within warm section 24), for example, by movement of chamber 27 to a position above cavity 6 and the opening of valves 7*a* and 8*a*. Once these actions take place, the 'warm' fluid 30 flows through fluid line 32 into cavity 6, thus displacing 'cold' fluid 30. In turn, 'cold' fluid 30 flows down into chamber 28 (located below cavity 6) via fluid line 34. Ultimately, the introduction of the 'warm' heat exchanging fluid 30 into cavity 6 can assist in the release of ice pieces formed in receptacles 4. It is also possible to introduce 'warm' fluid 30 into an empty cavity 6 to accomplish the same function. Either way, heat from 'warm' fluid 30 in cavity 6 is conducted to receptacles 4, causing localized melting of the ice pieces. Movement of tray 10 from an upward to a downward position can then be used to release and harvest the ice pieces. As necessary, tray 10 can also be twisted to provide further assistance for the ice piece releasing step. Furthermore, the 'warm' heat exchanging fluid 30 remaining in cavity 6 can be removed through adjustments to valves 7*a* and 8*a* after the release of the ice pieces.

Still further, this 'cold' fluid 30, now residing in chamber 28, can be used to assist in new ice piece formation within the receptacles 4 of tray 10. Once the ice pieces have been harvested from the tray 10, water can be introduced into the receptacles 4 from dispenser apparatus (not shown) for further ice piece production. Chamber 28 containing the 'cold' fluid 30 can then be moved to a position above cavity 6 by driving body 29. Valve 8*a* can then be opened, allowing flow of the 'cold' fluid 30 through fluid line 34 into cavity 6. This action displaces the 'warm' fluid 30 residing in cavity 6. For example, 'warm' fluid 30 can then flow through valve 7*a* (open), and back into chamber 27. Still further, the 'cold' fluid 30 in cavity 6 may be allowed to remain in cavity 6 only for a prescribed period of time to optimize the heat conduction and convection aspects of the ice piece formation. For instance, the openings of valves 7*a* and 8*a* can be adjusted relative to one another to affect this dwell time. Another approach is to open valve 7*a* after a set time to move the 'cold' fluid 30 out of the cavity 6. In sum, the introduction of the 'cold' fluid 30 into the cavity 6 (and the control of its dwell time) aids in the freezing of the water in receptacles 4 into ice pieces via the conduction processes outlined earlier.

The designs of system 20 and, more particularly tray 10 and primary reservoir assembly 26, depicted in FIG. 2 are merely exemplary. Various tray configurations are viable, provided that the tray contains a suitable cavity 6 to enable thermal conduction between heat exchanging fluid 30 and receptacles 4. Moreover, additional dividers comparable to divider 9 and valves comparable to valves 7*a* and 8*a* may be located within chamber 6 to further control flow and dwell time of heat exchanging fluid 30. Still further, cavity 6 need not reside beneath receptacles 4 (as shown in FIGS. 1A and 1B). Rather, cavity 6 may be configured in a band-like cavity around the periphery of receptacles 4 (not shown). This arrangement can then facilitate better heat conduction and convection from the chilled compartment 22 through the bottom of receptacles 4, while at the same time facilitating conduction from the heat exchanging fluid 30 (or fluid 12) through band-like cavity 6 to the top portion of receptacles 4. As such, the design of cavity 6 can be configured to maximize the cooling afforded by heat exchanging fluid 30 and the chilled compartment 22.

Indeed, configurations within cavity 6 are flexible that allow controlled introduction and dwell times of heat exchanging fluid 30 into portions of cavity 6 (e.g., the left or right side of cavity adjacent to the axis of rotation of tray 10) to facilitate rotation of tray 10 for ice piece harvesting purposes. Moreover, the movement of tray 10 (e.g., rotational movement) can be affected by the flow of heat exchanging fluid 30. As such, tray 10 can be placed into an off-balance condition when 'cold' heat exchanging fluid 30 is removed and 'warm' heat exchanging fluid 30 is allowed to flow into cavity 6. This action can assist or cause the tray 10 to rotate for ice piece harvesting. Still further, the stiffness of fluid lines 32 and 34 can be adjusted to assist or cause rotation of tray 10 from the movement of chambers 27 and 28 by driving body 29. For example, the length or stiffness properties of lines 32 and 34 can be adjusted to produce the desired rotation to tray 10 as chambers 27 and 28 are moved for ice piece release and ice piece formation purposes. In effect, the motion of chambers 27 and 28 is translated to lines 32 and 34, and then on to tray 10.

Likewise, chambers 27 and 28 can take various shapes and sizes, provided that they can accommodate various volumes of heat exchanging fluid 30. In addition, it can be preferable to provide thermal insulation to one of the chambers 27 or 28, and designate that chamber for containment of 'cold' heat exchanging fluid 30. Moreover, other control mechanisms relying on controller 14 are viable, including the addition of valves (not shown) between fluid lines 32 and 34 and chambers 27 and 28, respectively. Sensors coupled to controller 14 could also be added to chambers 27 and 28, and cavity 6, to ascertain the level and volume of heat exchanging fluid 30 at those locations.

In addition, various configurations of warm section 24 and chilled compartment 22 are feasible. For example, warm section 24 may be the fresh food compartment in a refrigerator appliance. Warm section 24 may also exist in the door cavities of a refrigeration appliance or another location (e.g., a location external to insulated sections and compartments of the appliance) that ensures that the temperature of section 24 exceeds 0° C. Chilled compartment 22 may be a freezer, ice making zone or other location in a refrigerator appliance where the temperature is below 0° C.

There are many advantages and benefits of the ice piece release and formation system 20 depicted in FIG. 2. The system 20 conserves thermal energy in the refrigerator, reducing overall energy usage by the appliance. For example, the ability of system 20 to improve ice release within the receptacles 4 of tray 10 significantly reduces energy usage. With the use of system 20, it is not necessary to employ resistive ice tray heaters to release the ice pieces from tray 10. Only limited amounts of additional energy are required to operate the valves 7*a* and 8*a*, controller 14 and driving body 29.

Still further, the ability of ice piece system 20 to improve the rate of ice piece formation in receptacles 4 of tray 10 also reduces energy consumption by the appliance. Thermal heat conduction via heat exchanging fluid 30 is a much more efficient process for freezing water into ice as compared to conventional systems dominated by convective processes. Accordingly, heat is removed from the water more efficiently by system 20, requiring less compressor usage or reductions in the periods of compressor operation in the appliance.

Figure 3:
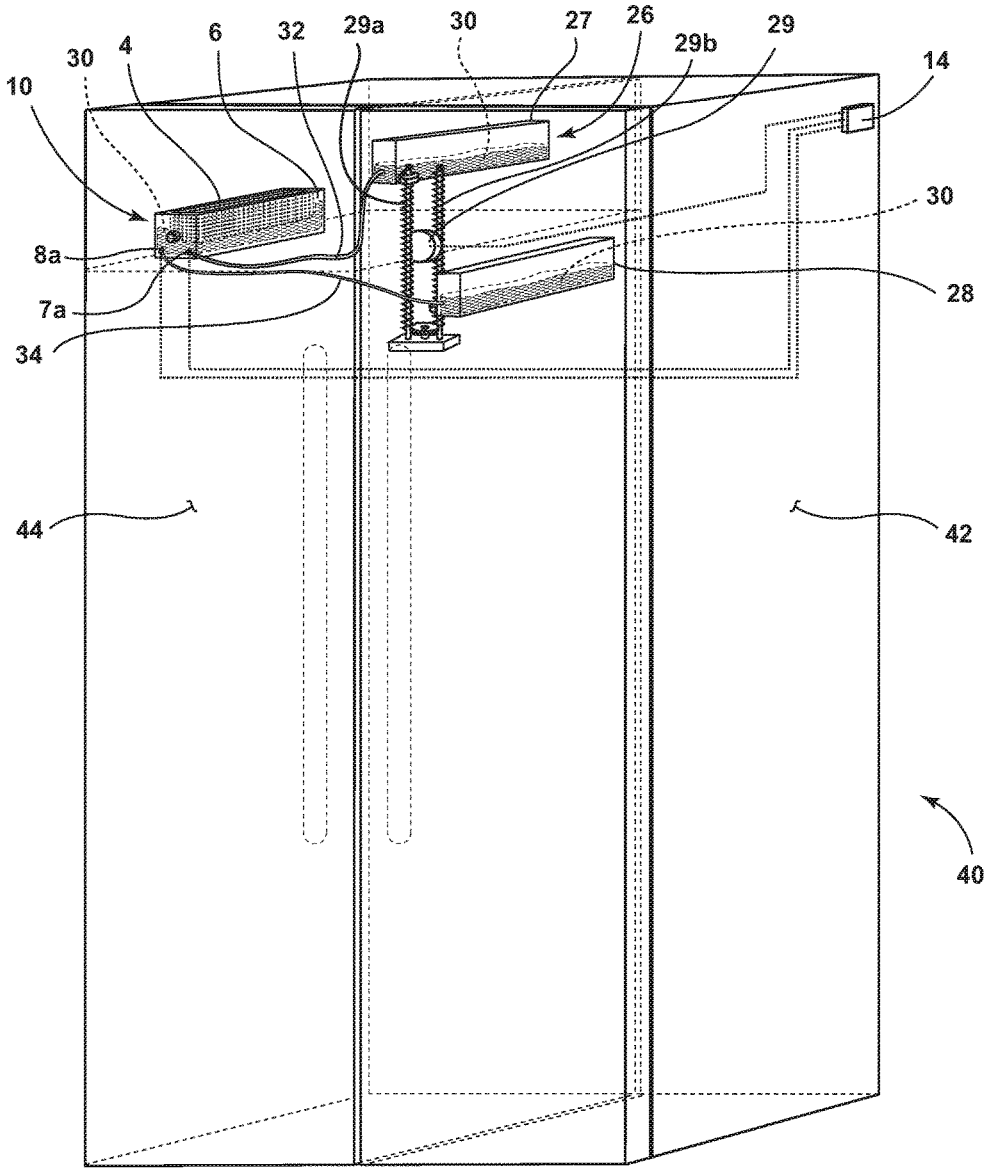
FIG. 3 is a cut-away perspective view of a refrigerator appliance in a side-by-side configuration with an ice piece release and formation system that includes a primary reservoir assembly in the fresh food compartment according to a further aspect of the disclosure.
Figure 3A:
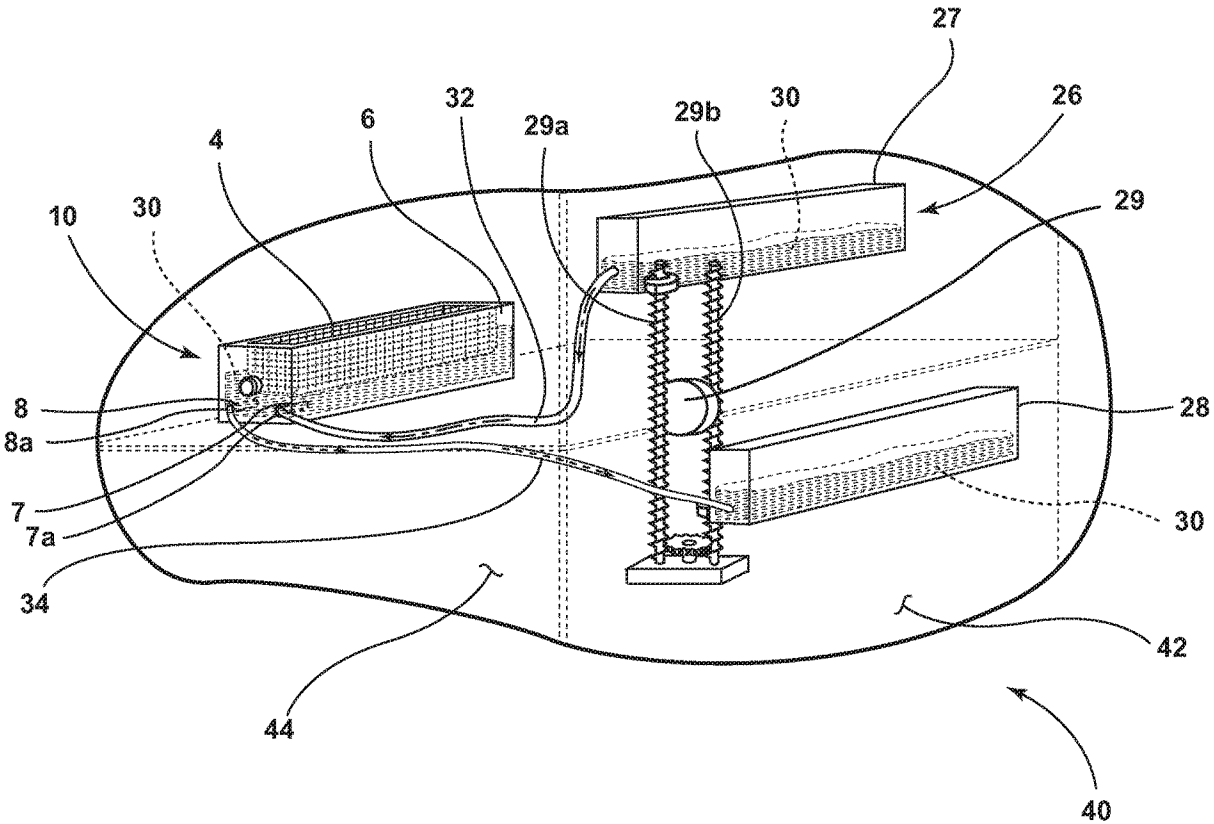
FIG. 3A is an enlarged, cut-away view of the ice piece release and formation system depicted in FIG. 3.

As shown in FIGS. 3 and 3A, a refrigerator appliance in a side-by-side configuration is depicted with an ice release and formation system 40 according to another aspect of this disclosure. The side-by-side system 40 includes a fresh food compartment 42 with a compartment door 43, and a freezer compartment 44 with a freezer compartment door 45. Compartments 42 and 44 are thermally separated. Other components associated with the system 40 are identical to those shown in FIG. 2 related to system 20 (e.g., heat exchanging fluid 30, first chamber 27, second chamber 28, etc.). Further, tray 10 is located within freezer compartment 44 and thus is in thermal communication with this compartment. Likewise, primary reservoir assembly 26 is located within fresh food compartment 42 and thus is in thermal communication with this compartment.

In addition, the operation of system 40 depicted in FIGS. 3 and 3A is comparable to that described in connection with system 20 (see FIG. 2). For example, system 40 can be employed to assist in the release of ice pieces formed in receptacles 4 of tray 10. 'Warm' heat exchanging fluid 30 within chamber 27 at a temperature above 0° C. can be introduced into the cavity 6 of tray 10 for this purpose. In particular, driving body 29 can be controlled by controller 14 to move chamber 27 to a vertical position above cavity 6 (e.g., through motion of shaft 29*a* caused by driving body 29). Valves 7*a* and 8*a* can then be opened by controller 14. At this point, the 'warm' heat exchanging fluid 30 will flow at least in part by the force of gravity via fluid line 32 into cavity 6. Colder heat exchanging fluid 30 previously residing in cavity 6 is then displaced to chamber 28 via fluid line 34. The introduction of 'warm' heat exchanging fluid 30 in cavity 6 causes the bond between ice pieces and the receptacles 4 to break, thus releasing the ice pieces. Tray 10 can then be further twisted and/or rotated for ice piece harvesting.

Figure 3B:
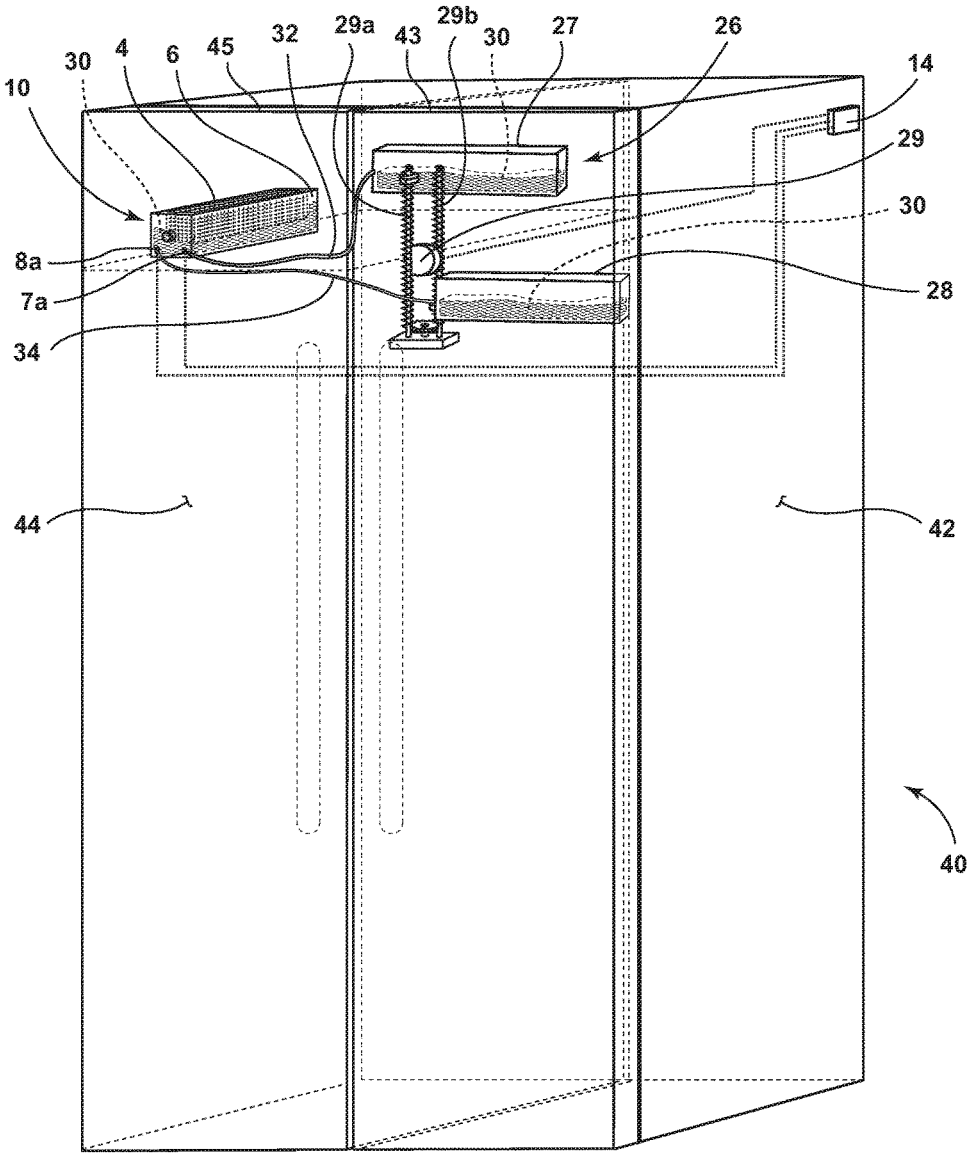
FIG. 3B is a cut-away perspective view of a refrigerator appliance in a side-by-side configuration with an ice piece release and formation system that includes a primary reservoir assembly in the interior portion of an exterior door of a fresh food compartment according to an additional aspect of the disclosure.

Referring to FIG. 3B, a refrigerator appliance in a side-by-side configuration is depicted with an ice release and formation system 40 according to a further aspect of this disclosure. Here, system 40 is configured with primary reservoir assembly 26 within an interior portion of fresh food compartment door 43. The interior of fresh food compartment door 43 is maintained at temperatures above 0° C. In all other respects, system 40 as shown in FIG. 3B is the same as system 40 depicted in FIGS. 3 and 3A.

Figure 3C:
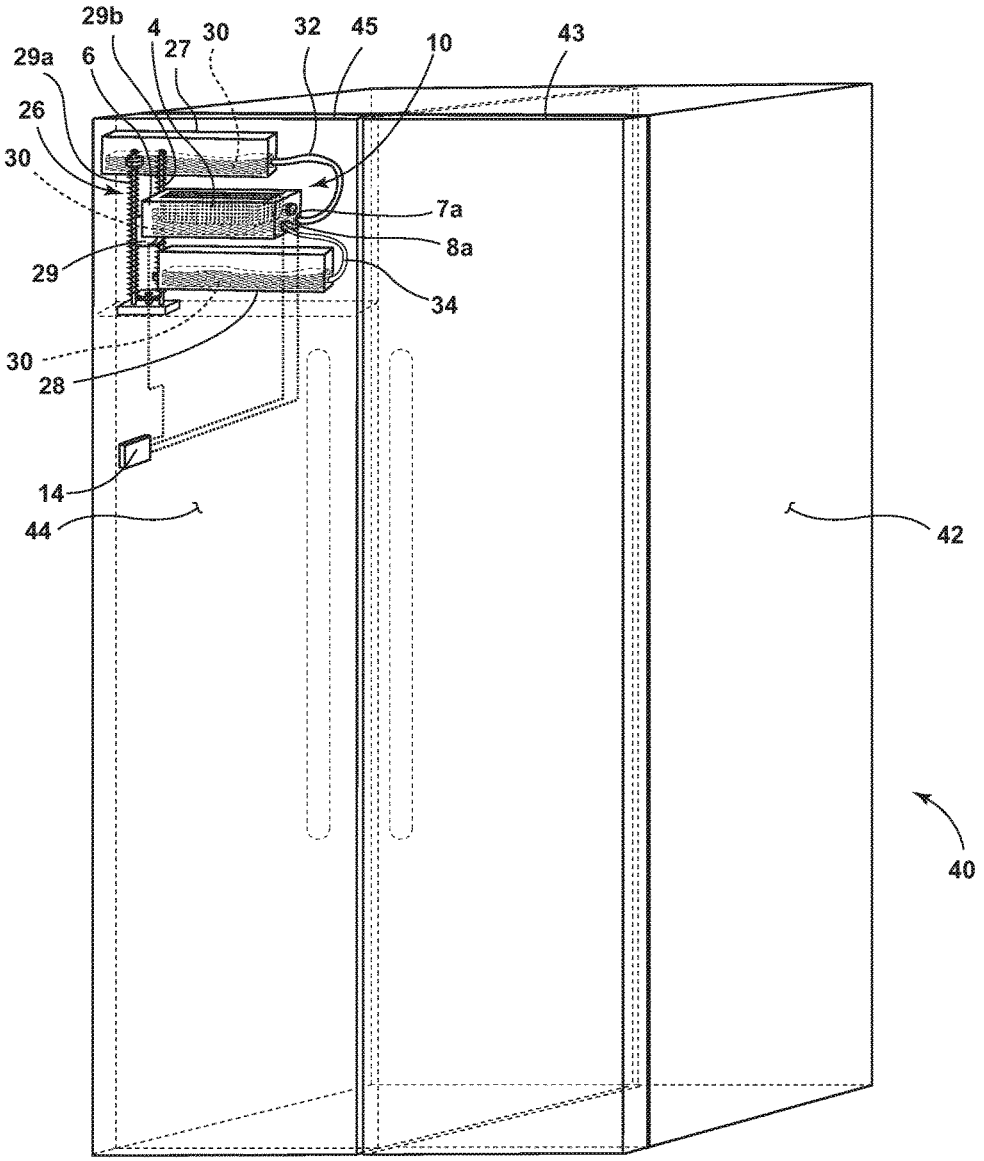
FIG. 3C is a cut-away perspective view of a refrigerator appliance in a side-by-side configuration with an ice piece release and formation system that includes a primary reservoir assembly in the interior portion of an exterior door of the chilled compartment according to another aspect of the disclosure.

FIG. 3C depicts another configuration for system 40. Here, the primary reservoir assembly 26 is depicted within an interior portion of freezer compartment door 45. More specifically, the interior portion of freezer compartment door 45 housing the reservoir assembly 26 is maintained at a temperature above 0° C. In all other respects, system 40 as shown in FIG. 3C is the same as system 40 depicted in FIGS. 3 and 3A. In addition, the operation of the system 40 depicted in FIGS. 3B and 3C is comparable to that described in connection with system 20 (see FIG. 2).

Figure 4:
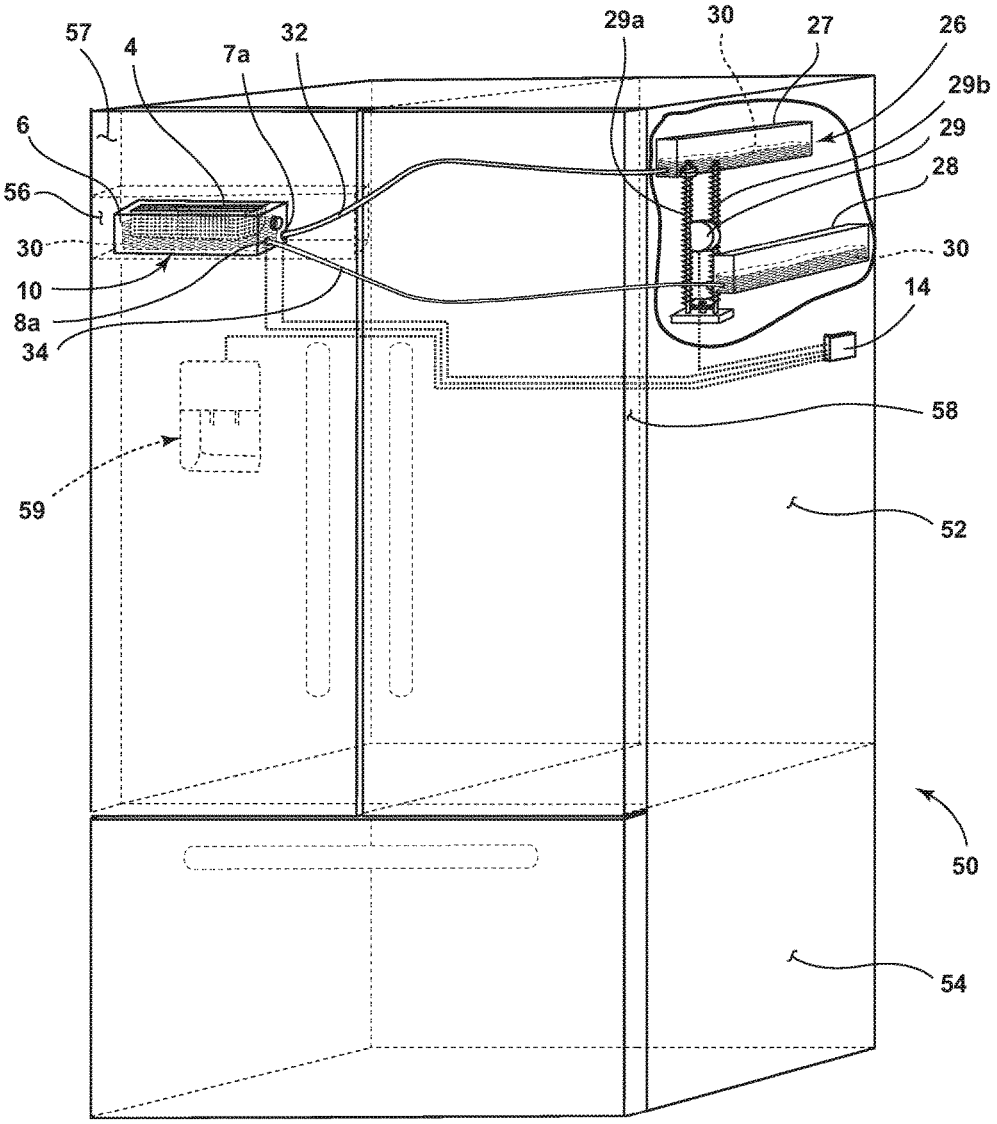
FIG. 4 is a cut-away perspective view of a refrigerator appliance in a French door bottom mount configuration with an ice piece release and formation system that includes a primary reservoir assembly in a fresh food compartment according to a further aspect of the disclosure.

As shown in FIG. 4, a refrigerator appliance in a French door bottom mount (FDBM) configuration is depicted with an ice release and formation system 50 according to a further aspect of this disclosure. Here, the FDBM system 50 includes a fresh food compartment 52 with a left compartment door 57 having an ice piece making zone 56 (at a temperature below 0° C.) and an ice piece dispenser 59. Fresh food compartment 52 also includes a right compartment door 58. The FDBM system also includes a freezer compartment 54. Compartments 52 and 54 are thermally separated.

Other components associated with the system 50 are identical to those shown in FIG. 2 that are related to system 20 (e.g., heat exchanging fluid 30, first chamber 27, second chamber 28, etc.). Further, tray 10 is located within ice piece making zone 56 and thus is in thermal communication with this compartment. Likewise, primary reservoir assembly 26 is located within fresh food compartment 52 and thus is in thermal communication with this compartment. The operation of system 50 depicted in FIG. 4 is comparable to that described in connection with system 20 (see FIG. 2).

Figure 4A:
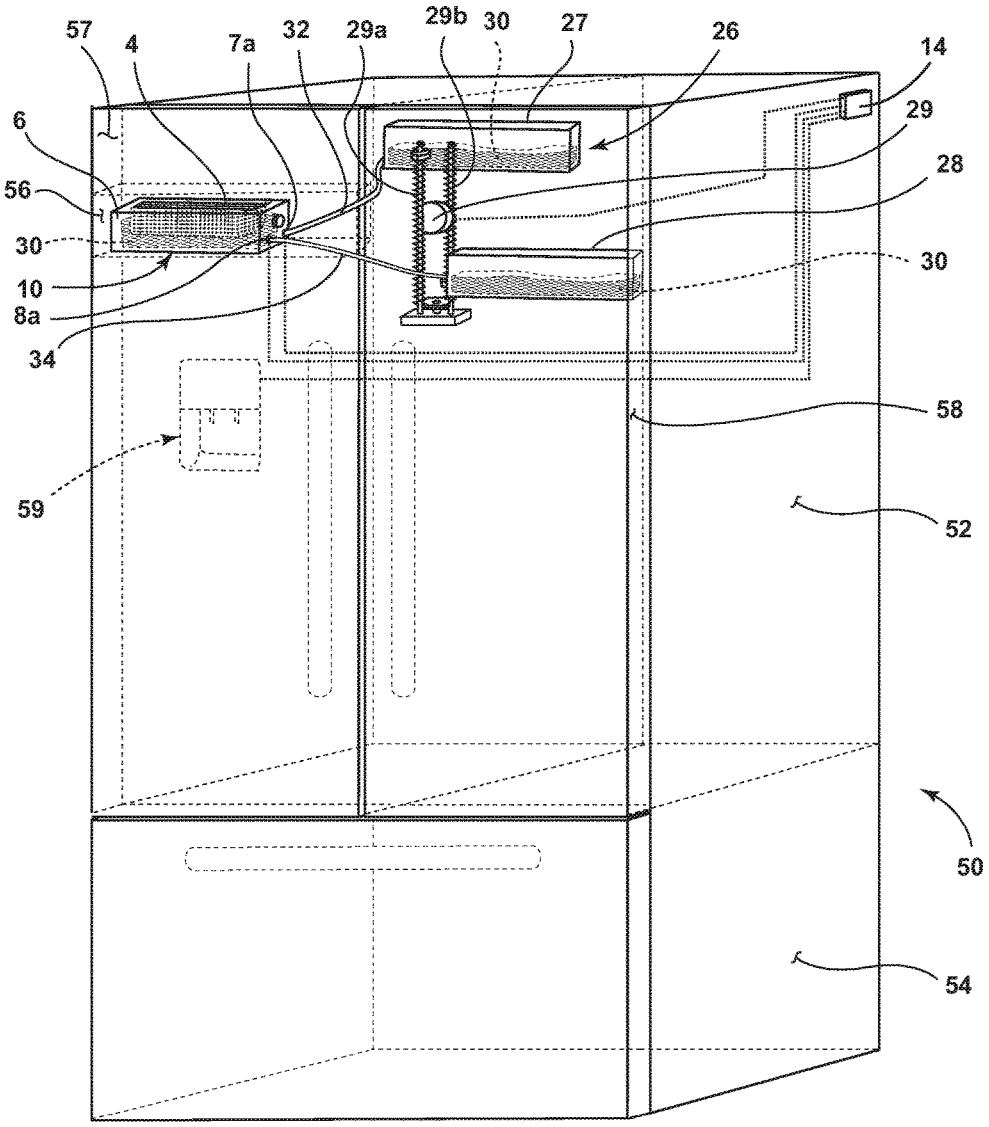
FIG. 4A is a cut-away perspective view of a refrigerator appliance in a French door bottom mount configuration with an ice piece release and formation system that includes a primary reservoir assembly in an interior portion of an exterior door of a fresh food compartment according to an additional aspect of the disclosure.

Referring to FIG. 4A, a refrigerator appliance in a FDBM configuration is depicted with an ice release and formation system 50 according to another aspect of this disclosure. Here, system 50 is configured with primary reservoir assembly 26 within an interior portion of the right compartment door 58 associated with the fresh food compartment 52. Further, the primary reservoir assembly 26 can also be located within an interior portion of left compartment door 57 and adjacent tray 10 (located within ice piece making zone 56). The interiors of right compartment door 58 and left compartment door 57 are maintained at temperatures above 0° C. In all other respects, system 50 as shown in FIG. 4A is the same as system 50 depicted in FIG. 4. In addition, the operation of the system 50 depicted in FIG. 4A is comparable to that described in connection with system 20 (see FIG. 2).

Other variations and modifications can be made to the aforementioned structures and methods without departing from the concepts of the present disclosure. These concepts, and those mentioned earlier, are intended to be covered by the following claims unless the claims by their language expressly state otherwise.

We claim:

1. An ice piece release system, comprising:
a chilled compartment set at a temperature below 0° C.;
a warm section set at a temperature above 0° C.;
a tray in thermal communication with the chilled compartment, the tray having a plurality of ice piece-forming receptacles and a cavity in thermal communication with the receptacles;
a primary reservoir assembly in thermal communication with the warm section and fluid communication with the cavity of the tray; and
a heat-exchanging fluid having a freezing point below that of water,
wherein the primary reservoir assembly further comprises at least one chamber, each chamber in fluid communication with the cavity of the tray,
wherein the fluid resides in one or more of the cavity and the at least one chamber, and
further wherein the primary reservoir assembly is adapted to move heat-exchanging fluid in the at least one chamber into the cavity.

2. The system according to claim 1, wherein the at least one chamber is a plurality of chambers, each chamber in fluid communication with the cavity of the tray.

3. The system according to claim 1, wherein the primary reservoir assembly further comprises a driving body configured to move heat-exchanging fluid in each chamber into the cavity.

4. The system according to claim 1, wherein the warm section is an interior portion of an exterior door of the chilled compartment.

5. The system according to claim 1, wherein the warm section is a fresh food compartment.

6. The system according to claim 1, wherein the heat-exchanging fluid is a liquid that comprises water and a food-safe additive to depress the freezing point of the fluid below that of water and the temperature in the chilled compartment.

7. The system according to claim 1, wherein the primary reservoir assembly is further adapted to move heat-exchanging fluid in each chamber into the cavity by the force of gravity.

8. The system according to claim 1, wherein the primary reservoir assembly is further configured to move each chamber to a position above the tray to move heat-exchanging fluid in each chamber into the cavity.

9. The system according to claim 1, wherein the tray further comprises a membrane that separates the cavity from the receptacles.

10. An ice piece release system, comprising:
a chilled compartment set at a temperature below 0° C.;
a warm section set at a temperature above 0° C.;
a tray in thermal communication with the chilled compartment, the tray having a plurality of ice piece-forming receptacles and a cavity in thermal communication with the receptacles;
a primary reservoir assembly in thermal communication with the warm section and fluid communication with the cavity of the tray; and
a heat-exchanging fluid having a freezing point below that of water,
wherein the fluid resides in one or more of the cavity and the primary reservoir assembly, and
further wherein the primary reservoir assembly is adapted to move heat-exchanging fluid in the reservoir assembly into the cavity by the force of gravity.

11. The system according to claim 10, wherein the primary reservoir assembly further comprises a driving body configured to move heat-exchanging fluid in the primary reservoir assembly into the cavity.

12. The system according to claim 10, wherein the warm section is an interior portion of an exterior door of the chilled compartment.

13. The system according to claim 10, wherein the warm section is a fresh food compartment.

14. The system according to claim 10, wherein the heat-exchanging fluid is a liquid that comprises water and a food-safe additive to depress the freezing point of the fluid below that of water and the temperature in the chilled compartment.

15. The system according to claim 10, wherein the primary reservoir assembly is further configured to move above the tray to move heat-exchanging fluid in the primary reservoir assembly into the cavity.

16. The system according to claim 10, wherein the tray further comprises a membrane that separates the cavity from the receptacles.

17. An ice piece tray assembly, comprising:

a plurality of ice piece-forming receptacles;

a cavity in thermal communication with the receptacles; and a membrane that separates the cavity from the receptacles, wherein the cavity is configured to receive a heat exchanging fluid to aid in the release of ice pieces that are formed in the receptacles.

18. The tray assembly of claim 17, wherein the cavity is configured with a plurality of ports for controlling a flow of heat-exchanging fluid to aid in the release of ice pieces that are formed in the receptacles.

19. The tray assembly of claim 18, further comprising:

a plurality of valves coupled to a controller and the plurality of ports, the controller configured to control the flow of heat-exchanging fluid through the ports by operation of the plurality of valves.

20. The tray assembly of claim 17, further comprising:

a mechanical apparatus to aid in the release of ice pieces that are formed in the receptacles.

* * * * *